US007144185B2

(12) United States Patent
Messerschmidt et al.

(10) Patent No.: US 7,144,185 B2
(45) Date of Patent: Dec. 5, 2006

(54) STREET GRID FOR SURFACE DRAINAGE

(75) Inventors: Heino Messerschmidt, Lütjenwestedt (DE); Michael Sieber, Timmaspe (DE)

(73) Assignee: ACO Severin Ahlmann GmbH & Co. KG, Rendsburg (DE)

( * ) Notice: Subject to any disclaimer, the term of this patent is extended or adjusted under 35 U.S.C. 154(b) by 0 days.

(21) Appl. No.: 11/204,714

(22) Filed: Aug. 16, 2005

(65) Prior Publication Data

US 2005/0271468 A1 Dec. 8, 2005

Related U.S. Application Data

(63) Continuation of application No. PCT/EP2004/001364, filed on Feb. 13, 2004.

(30) Foreign Application Priority Data

Feb. 17, 2003 (DE) ..... 103 06 556
Mar. 19, 2003 (DE) ..... 103 12 239

(51) Int. Cl.
*E01F 5/00* (2006.01)

(52) U.S. Cl. ..... 404/4; 210/164

(58) Field of Classification Search ..... 404/2, 404/4; 210/163, 164
See application file for complete search history.

(56) References Cited

U.S. PATENT DOCUMENTS 124,061 A * 2/1872 Hodgman ..... 404/2
134,978 A * 1/1873 Clapp ..... 210/459
1,099,069 A * 6/1914 Matthews et al. ..... 137/247.19
1,654,886 A * 1/1928 Keeble et al. ..... 210/163
1,659,307 A * 2/1928 Wittman ..... 210/163
2,701,027 A * 2/1955 Scoville ..... 210/163
3,815,749 A * 6/1974 Thompson ..... 210/163
4,067,659 A * 1/1978 Campagna et al. ..... 404/25
4,909,660 A * 3/1990 Ferns ..... 404/2
4,955,752 A * 9/1990 Ferns ..... 404/2
6,340,267 B1 * 1/2002 Kortmann ..... 404/2

FOREIGN PATENT DOCUMENTS

| | | | |
|---|---|---|---|
| DE | 1 802 193 | | 12/1959 |
| DE | 1 759 544 | | 10/1969 |
| DE | 20 46 041 | | 3/1972 |
| DE | 80 03 367 | U1 | 6/1980 |
| DE | 81 26 693.6 | U1 | 2/1982 |
| DE | 35 23 423 | C1 | 1/1987 |
| DE | 89 10 414 | U1 | 12/1989 |
| DE | 38 32 992 | A1 | 4/1990 |
| DE | 296 14 372 | U1 | 1/1997 |
| FR | 2 713 254 | * | 6/1995 |
| GB | 311566 | | 5/1929 |
| GB | 1081025 | | 8/1967 |

* cited by examiner

*Primary Examiner*—Gary S Hartmann
(74) *Attorney, Agent, or Firm*—Akin Gump Strauss Hauer & Feld, LLP

(57) ABSTRACT

A street grid is provided for surface drainage. The grid includes a frame and a grating, which are adapted to the contours of a paved gully in order to be integrated into the latter, for draining water that flows towards the street grid in a pre-defined flow direction. The aim of the grid is to ensure permanent drainage. To achieve this, recessed inlet openings are provided in the upper edge of at least one lateral wall of the frame in order to guide the water in the flow direction.

6 Claims, 2 Drawing Sheets

FIG. 4: IV-IV

STREET GRID FOR SURFACE DRAINAGE

CROSS-REFERENCE TO RELATED APPLICATIONS

This application is a continuation of International Application No. PCT/EP2004/001364, filed Feb. 13, 2004, which was published in the German language on Aug. 26, 2004, under International Publication No. WO 2004/072392 A1 and the disclosure of which is incorporated herein by reference.

FIELD OF THE INVENTION

The invention relates to a street grid for surface drainage consisting of a frame and a grating that are adapted to the contours of a paved gully in which they are to be installed, in order to drain away water that flows toward the street grid in a predetermined direction.

BACKGROUND OF THE INVENTION

Such street grids for surface drainage are known and as a rule are installed in such a way that the surface of the frame and the surface of the grating are flush with the upper edge of the paved gully. Water flowing toward the street grid within the gully, derived for example from rain or melting snow, then enters the street drainage system by passing over the frame and through the grating. Another embodiment of a street grid is conceived such that the water flowing toward it enters primarily between the frame and the grating, and is additionally diverted so as to enter by way of the grating only if the influx increases.

In the case of existing street grids in channel form, in practice it can happen that after an input channel has been completed, for instance a pavement channel or one made of gully stones, it can settle to a different extent than the street grid. Because of unpredictable features of the ground structure, overloading or design deficiencies, such differences are to some extent unavoidable. If as a result the upper edge of the grid frame is higher than the bottom of the channel, the water flowing in through the channel is no longer completely drained away, and residual puddles are produced in the channel and in the adjacent surfaces because the water builds up against the upper edge of the grid frame.

These residual puddles are problematic and dangerous both for pedestrians and also for traffic flow. Furthermore, they also result in damage to the drainage system in general. If the water in the puddles freezes, very large pressures are generated especially at the junctions between channel and adjacent surface, for example a sidewalk; these forces can enlarge the gaps at the junctions and thus loosen the seating of the whole drainage channel, so that eventually the structure is destroyed. Because of these subsidence hollows solid materials contained in the water, such as leaves, pollen or loose chippings, can no longer be completely transported away and are deposited in front of the edge of the street-grid frame. Especially in the case of grids such that the water primarily flows away between frame and grating, these suspended masses rapidly cause blockages that in this case, because of their awkward positions, can be cleared only by hand or with high pressure. A self-cleaning process is hardly to be expected here.

BRIEF SUMMARY OF THE INVENTION

It is an object of the present invention to provide a street grid of the kind cited at the outset which overcomes or substantially mitigates the aforementioned drainage problem.

According to the present invention there is provided a street grid for surface drainage for installation in a paved channel to the contours of which it is adapted in order to drain away water that flows toward the street grid in a predetermined flow direction, comprising a frame having at least one side wall with an upper edge that is adapted to guide water in said flow direction and that defines therein frame inlet openings in the form of depressions in said upper edge and a grating that defines grating inlet openings which are shaped so as to correspond to the frame inlet openings.

A street grid for surface drainage in accordance with the present invention has substantial advantages. It is no longer crucial for the functionality of the drainage system that the upper edge of the frame be precisely level with, or below, the height of the bottom of the input channel. Because the water also flows away through the inlet openings formed at the upper edge of the frame, with the present invention water can continue to flow into the drainage system even if the level of the channel is below that of the upper edge of the street grid. In the case of level differences between the input and the street grid, therefore, the drainage performance is no longer thereby restricted. Hence the problem of formation of residual puddles no longer presents any danger, because the water does not build up at the edge of the street grid and in whatever hollows have been formed by settling, but instead can be conducted away through the recessed openings in the upper edge of the street-grid frame. As a result, not only is the working life of the drainage channel increased; instead, this design principle also produces distinct savings with respect to the costs of maintenance, cleaning and sanitation, or reconstruction. Unpleasant, in some cases even dangerous water-covered areas in front of the street grid are avoided, because the water is efficiently carried away despite subsidence of the input channel.

With an embodiment in which the approaching water flows into the street grid over the upper edges of frame and grating, in addition the risk of blockage of the grid is reduced, because no solid materials become caught between frame and grating so that they could obstruct the drainage system; the functional reliability is distinctly increased.

The inlet openings can be chosen arbitrarily, regarding their nature and construction. However, it is especially advantageous to construct the inlet openings on both the frame and, where desired, the grid as recesses. This reduces to a particularly great degree the risk of blockage of the drainage arrangement by solid materials or cohesive particles in the water that is to be drained; deposited solids are swept away when the next relatively large discharge of water occurs. Cleaning of inlet openings that have been clogged by external, mechanical actions, such as stones wedged in by pedestrians, is also considerably simplified.

Owing to the accessibility from above usual street-cleaning work is sure to make any clogged inlet openings passable again.

It is also advantageous for the grating and frame inlet openings to slant downward towards the interior. This ensures a particularly effective entry because the water, which sometimes flows to the grid very slowly, is speeded up as it flows into the grid, so that the deposition of solid materials is prevented.

Another advantageous design of the invention is achieved by arranging the grating and frame inlet openings off-center in the region of the bottom of the channel. The advantage here is that fixing elements present on the grating, which are usually disposed in the middle, are protected from dirt. Furthermore, a statically required web is frequently present along the middle axis of gratings. When the inlet openings are arranged apart from the middle axis, no expensive reconstruction needs to be undertaken in gratings of known design. This considerably reduces the manufacturing costs and contributes to a broad area of application.

A preferred embodiment of street grid in accordance with the invention is one in which the basic area of the street grid has an oval or round configuration. In this case the lateral inflow openings are substantially uniformly distributed around the circumference of the grid. This street grid is employed particularly at points where two or more input channels converge. In the region where they flow to the street grid, these channels usually expand to form a kind of basin, and this is just the place where subsidence is observed, on account of the larger area of the basin and the partially one-sided loading because different amounts of water are flowing through the channels. Also, the problem of adapting the levels of several channels to one another becomes merely rudimentary. Slight differences in the input level are now tolerable. Furthermore, the street grid can of course have any other shape. Because of the location of the inlet openings at the sides of the frame, drainage of residual puddles is also possible in the case of, for instance, a rectangular, lectern-shaped street grid.

As a special feature, it is possible to make the depths of the inlet openings of frame and grating such as to correspond to the maximal settling that is expected for the input channels. Depending on external influences such as the structure of the soil, influences of the weather or the loads that are imposed by traffic, the amount of subsidence as a rule varies immensely. An expert can sometimes make an approximate calculation of the expected subsidence in advance. Then a precise match to the local environmental conditions is enabled by adjusting the depth of the grating and frame inlet openings. Especially when flat paving stones are used to line the channel, inlet openings that are too deep can cause the material under the supporting layers of the channel to be washed away. Since it is possible to adjust the depth of the inlet openings, this problem can be counteracted.

BRIEF DESCRIPTION OF THE DRAWING

In the following the present invention is described by way of example with reference to the attached drawings.

FIG. 4 is a part sectional view along the line IV—IV in FIG. 2,

DETAILED DESCRIPTION OF THE INVENTION

Figures 1, 2, 3:
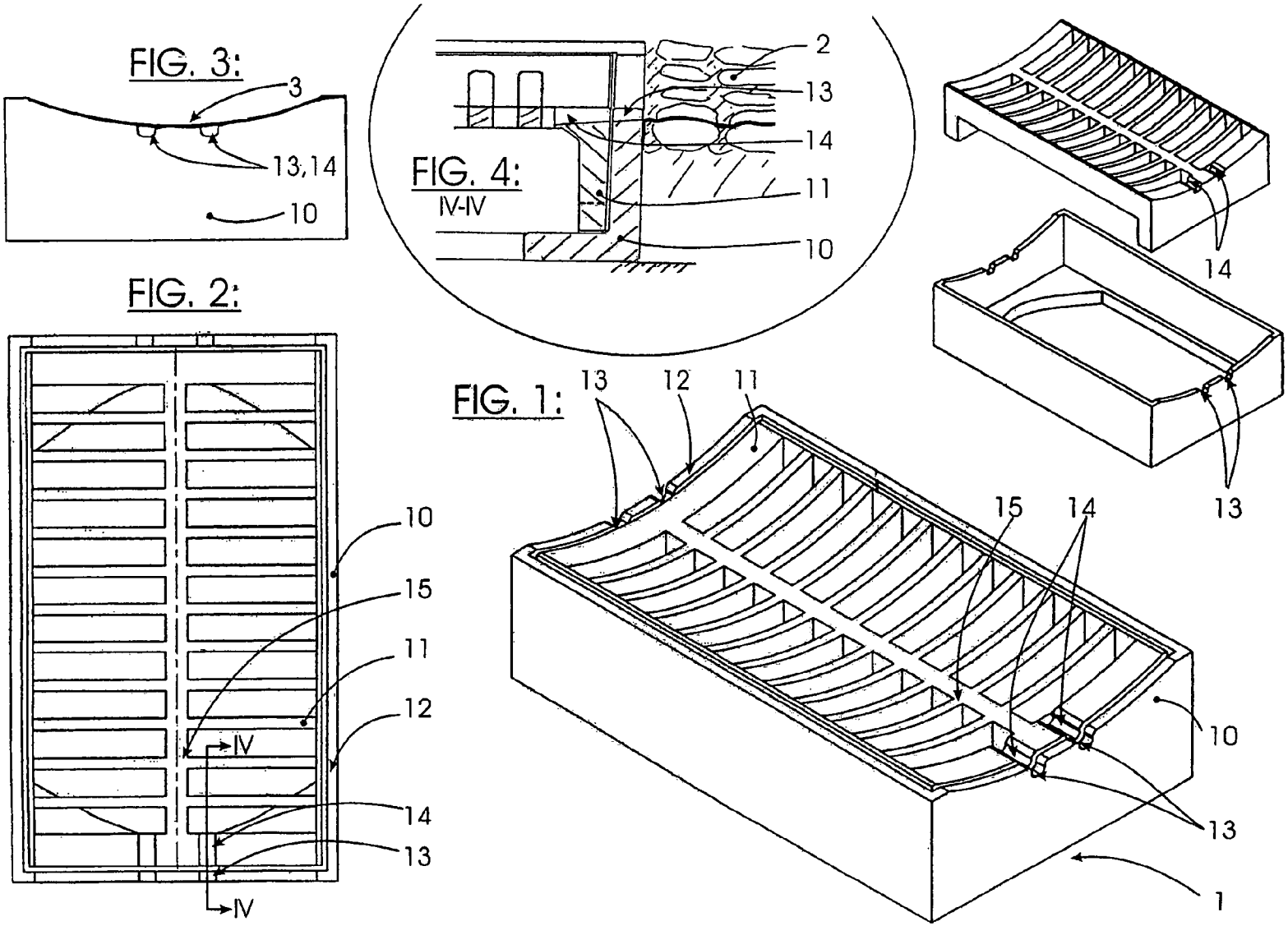
FIG. 1 is a perspective view of a first embodiment of the invention.
FIG. 2 is a plan view of the embodiment shown in FIG. 1.
FIG. 3 is a front view of the embodiment shown in FIG. 1.

In the following description, the same reference numerals are used for identical parts or parts with identical actions.

FIG. 1 is an isometric drawing of a street grid 1 consisting of a frame 10 and a grating 11 that is set into the frame 10. A frame upper edge 12 and the upper edge of the grating 11 are at the same level, as is made clear in FIG. 1. At the side wall of the frame 10 that leads in the flow direction, frame inlet openings 13 are formed in the frame upper edge 12, i.e. recesses in the frame. The grating 11 exhibits correspondingly shaped grating inlet openings 14. In a first exemplary embodiment of the invention the grating inlet openings 14 are positioned on the end face of the street grid 1, against which an input drainage channel 2 abuts. Water flowing toward the grid is, in the normal case, conducted into the street grid by way of the frame upper edge 12 and the upper edge of the grating 11. Now if there should be settling of the input channel 2, for instance because of mechanical overloading or unexpected subsidence in the supporting structure, the approaching water can nevertheless be conducted away into the street grid, through the frame inlet openings 13 and the grating inlet openings 14. As a result, drainage is guaranteed even if subsidence depressions have formed. The risk of water backing up against the upper edge 12 of the frame, forming so-called residual puddles, is thus eliminated. Furthermore, because approaching water flows into the interior of the street grid by way of the frame 13 and grating 14, no solid materials are retained so as to clog the passageway.

FIGS. 2 and 3 show plan and front views of a first exemplary embodiment according to FIG. 1. Here it is clear that the frame inlet openings 13 and the grating inlet openings 14 are disposed in the region of a channel bottom 3. It is reasonable for the inlet openings to be positioned off-center, because usually (as can be seen in FIG. 2) the grating 11 comprises a medially disposed web 15, needed for static purposes. As a result of the off-center position of the inlet openings 13, 14, on one hand the supporting structure of the grating 11 need not be modified, while on the other hand the retaining mechanisms that are present in many gratings 11 are protected from dirt.

In FIG. 3 is a front view of the first exemplary embodiment according to FIG. 1. This shows the configuration of the frame inlet openings 13 and grating inlet openings 14, which open upward. This embodiment greatly reduces the danger that the drainage system will become congested by residual puddles. Because of this hydraulically favorable shape, it is difficult for solid particles that are washed in by the drainage water to become lodged in the inlet openings 13, 14. However, this does not only reduce the risk of blockage of the drainage system associated with residual puddles; it also contributes in general to a greater functional reliability and ease of maintenance of the drainage system, because no solid materials can be deposited in the upwardly open frame inlet openings 13 and grating inlet openings 14. As is well known, any accumulation of a small amount of solid deposits would soon be followed by complete blockage of the system, because more surfaces are available for deposition of the solids subsequently washed in.

Furthermore, drainage systems can also become blocked as a result of external influences. For instance, stones or clumps of debris propelled into the street grids 1 by passing vehicles or pedestrians are often the reason for such blockage. The advantage of the present embodiment is that in the course of conventional street cleaning the inlet openings 13, 14—if they should happen to be clogged—can easily be cleaned out. It would be possible to clean them by hand, because they are easily accessible, but that is usually no longer necessary.

FIG. 4 gives a detailed view of a section along the line IV—IV. Here it is evident that the frame inlet openings 13 and the grating inlet openings 14 are correspondingly tilted downward toward the interior, which results in an especially effective removal of the water because the inflowing water is additionally accelerated at the transition to the street grid, which counteracts deposition of solid materials.

Figure 5:
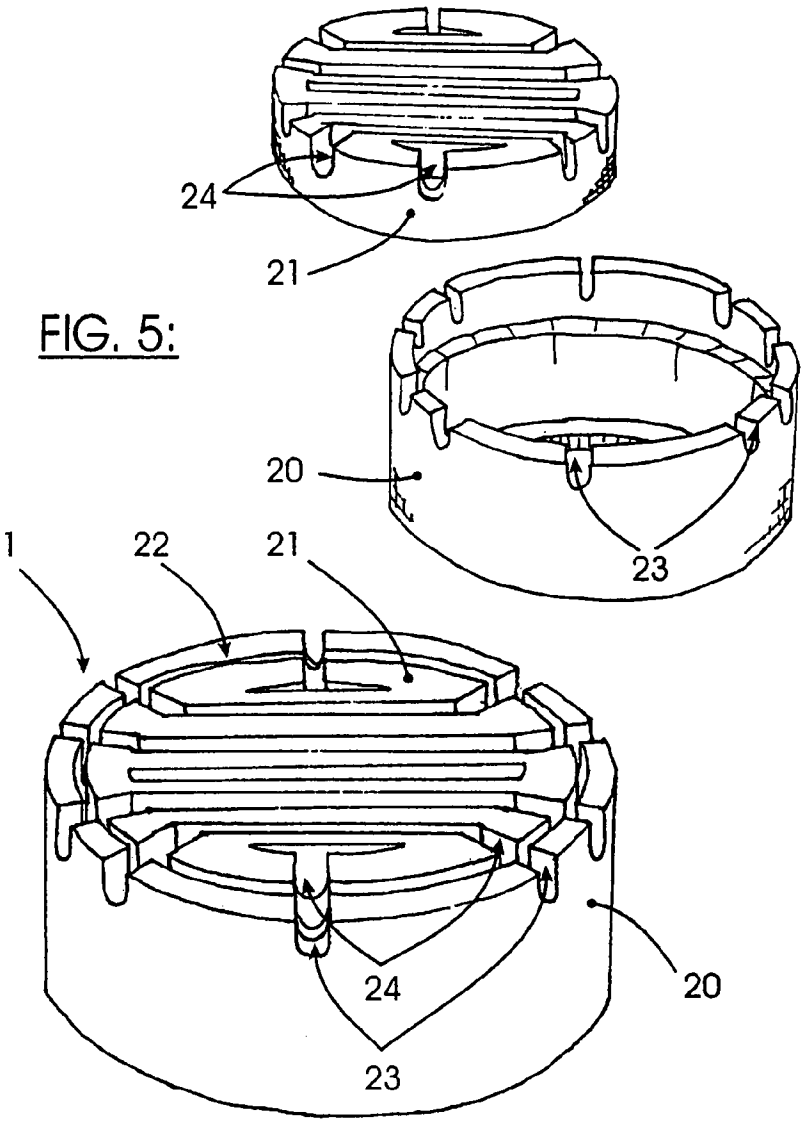
FIG. 5 shows perspective and perspective exploded views of a second embodiment of the present invention, which is constructed with round base area.
Figure 7:
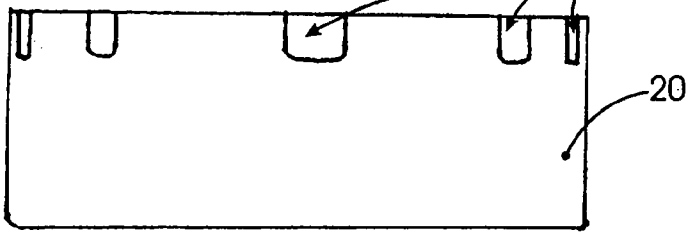
FIG. 7 is a front view of the embodiment shown in FIG. 5.
Figure 6:
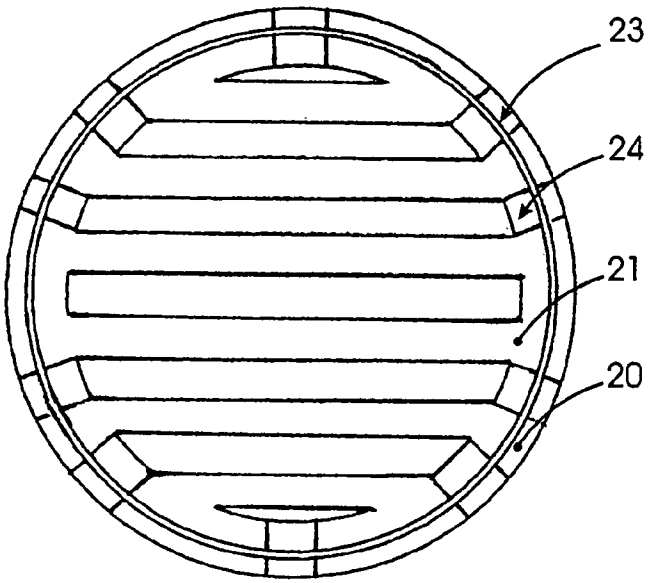
FIG. 6 is a plan view of the embodiment shown in FIG. 5.

FIGS. 5 to 7 show a second embodiment of a street grid 1 according to the present invention. With regard to its basic area this street grid 1 has a circular configuration. Frame inlet openings 23 and grating inlet openings 24 in this case are substantially uniformly distributed over the circumference. Here, again, inflowing water is conducted to the interior of the street grid 1 by way of a frame upper edge 22 and an upper edge of the grating 21. This street grid 1 is used when water is to be received from two or more channels 2. This embodiment ensures that even if the various input channels 2 differ in their level, because of settling or design faults, drainage into the street grid 1 is ensured. Hence by employing this street grid 1, construction of the system is simplified and the danger that residual puddles will form is decisively reduced, which results in all the advantages cited with respect to the first embodiment.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A street grid for surface drainage for installation in a paved channel, in order to drain away water that flows toward the street grid in a predetermined flow direction, comprising:

a frame having at least one side wall having a contour which is adapted to a contour of said paved channel with an upper edge which is adapted to guide water in said flow direction;

at least one frame inlet opening in the form of a depression on a bottom of the upper edge of said frame;

and a grating having a contour corresponding to said contour of said frame, wherein said grating is provided with at least one grating inlet opening which corresponds to, is in alignment and is in direct fluid communication with said frame inlet opening.

2. The street grid according to claim 1, wherein the frame inlet openings and the grating inlet openings are configured as recesses.

3. The street grid according to claim 1 wherein said grating inlet openings and said frame inlet openings (14, 24; 13, 23) are constructed so as to be inclined downward toward the interior of the street grid.

4. The street grid according to claim 1, wherein said grating inlet openings and said frame inlet openings are disposed off-center, in the region of a bottom of said channel.

5. The street grid according to claim 1, which is configured as a round or an oval grid shape, said frame inlet openings and said grating inlet openings are disposed so as to be substantially uniformly distributed around the circumference of the grid.

6. The street grid according to claim 1, wherein said grating inlet openings and said frame inlet openings are constructed with a depth that is commensurate with a maximal expected depth of said paved channels.

* * * * *